US005417336A

United States Patent [19]

Cortez

[11] Patent Number: 5,417,336

[45] Date of Patent: May 23, 1995

[54] NON-SPILL MEDICINE BOTTLE

[76] Inventor: Michael M. Cortez, 688 Riddle Rd., Apt. 500D, Cincinnati, Ohio 45220

[21] Appl. No.: 192,354

[22] Filed: Feb. 7, 1994

[51] Int. Cl.[6] ..... B65D 23/12

[52] U.S. Cl. ..... 215/386; 220/603; 220/375; 222/547

[58] Field of Search ..... 220/603, 705, 719, 731, 220/734, 375, 306; 215/100 R; 222/564, 547

[56] References Cited

U.S. PATENT DOCUMENTS 1,589,771 6/1926 Tucker ..... 220/375
2,802,608 8/1957 Gassaway ..... 222/564 X
2,955,468 10/1960 Hein, Jr. ..... 215/306 X
4,949,880 8/1990 Bradley ..... 222/564 X
5,050,759 9/1991 Marble ..... 220/705
5,123,575 6/1992 Li ..... 222/547 X
5,154,321 10/1992 Shomer ..... 222/564 X

*Primary Examiner*—Allan N. Shoap
*Assistant Examiner*—Christopher J. McDonald

[57] ABSTRACT

A non-spill medicine bottle comprising a bottle having a body coupled to a neck terminating in an opening adapted to allow material to pour therethrough, the bottle having a plurality of plates defining a flow inhibitor disposed therein and coupled thereto, each plate offset from the other plates to define a plurality of channels, the channels adapted to inhibit the flow of material from the body at one position but allow the flow of material from the body at a plurality of positions.

2 Claims, 4 Drawing Sheets

NON-SPILL MEDICINE BOTTLE

BACKGROUND OF THE INVENTION

1. Field of the Invention

The present invention relates to non-spill medicine bottle and more particularly pertains to a non-spill medicine bottle which may be used to prevent spillage.

2. Description of the Prior Art

The use of bottles which can be used to prevent spillage is known in the prior art. More specifically, bottles heretofore devised and utilized for the purpose of preventing spillage are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,044,531 to Rhodes Jr. illustrates a bottle having spillage protection.

Other patents that illustrate components generally related to the present invention are U.S. Pat. Nos. 4,653,669 to von Holt; 4,733,788 to D'Amico; and 5,111,946 to Glanz.

While these devices fulfill their respective, particular objective and requirements, the aforementioned patents do not describe a non-spill medicine bottle that has a weighted portion formed thereon to automatically roll the bottle to a position to inhibit spillage, nor do they describe a non-spill medicine bottle that has a plurality of plates defining a flow inhibitor disposed therein and coupled thereto to inhibit spillage.

In this respect, the non-spill medicine bottle according to the present invention substantially departs from the conventional concepts and designs of the prior art, and in doing so provides an apparatus primarily developed for the purpose of preventing spillage.

Therefore, it can be appreciated that there exists a continuing need for an improved non-spill medicine bottle which can be used to prevent spillage. In this regard, the present invention substantially fulfills this need.

SUMMARY OF THE INVENTION

In the view of the foregoing disadvantages inherent in the known types of bottles for preventing spillage now present in the prior art, the present invention provides an improved non-spill medicine bottle wherein the same can be utilized for preventing spillage. As such, the general purpose of the present invention, which will be described subsequently in greater detail, is to provide a new and improved non-spill medicine bottle for preventing spillage which has all the advantages of the prior art and none of the disadvantages.

To attain this, the present invention essentially comprises a bottle having a tubular body coupled to an elongated neck, the neck terminating in an opening adapted to allow liquid to pour therethrough, the body having a weighted portion formed thereon with the periphery of the body defining an integral side, whereby when the bottle is freely placed on its side, it automatically rolls to a location such that the weighted portion faces downward, and a first plate and a second plate defining a flow inhibitor disposed within the neck and coupled thereto, the first plate aligned and offset from the second plate to define a channel therebetween, the channel adapted to inhibit the flow of liquid from the body when the weighted portion faces downward but allow the flow of liquid from the body when the weighted portion does not face downward.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved non-spill medicine bottle which has all the advantages of the prior art and none of the disadvantages.

It is another object of the present invention to provide a new and improved non-spill medicine bottle which may be easily and efficiently manufactured and marketed.

It is a further object of the present invention to provide a new and improved non-spill medicine bottle which is of durable and reliable construction.

An even further object of the present invention is to provide a new and improved non-spill medicine bottle which is susceptible of a low cost of manufacture with regard to both materials and labor, and which accordingly is then susceptible of low prices of sale to the consuming public, thereby making such a non-spill medicine bottle economically available to the buying public.

Still yet another object of the present invention is to provide a new and improved non-spill medicine bottle which provides in the apparatuses and methods of the prior art some of the advantages thereof, while simultaneously overcoming some of the disadvantages normally associated therewith.

Still another object of the present invention is to provide a new and improved non-spill medicine bottle that prevents or inhibits the contents of a bottle from spilling out in the event that the bottle is knocked over.

Yet another object of the present invention is to provide a new and improved non-spill medicine bottle that is weighted so that if it is knocked over, it automatically rolls into a position with the weight on the bottom.

Yet another object of the present invention is to provide a new and improved non-spill medicine bottle that contains a built-in structural flow inhibitor to inhibit flow from the bottle in one position yet permit free flow from the bottle from a plurality of positions.

Yet another object of the present invention is to provide a new and improved non-spill medicine bottle that prevents or reduces spills even if the user can't react fast enough to stand the bottle upright.

Yet another object of the present invention is to provide a new and improved non-spill medicine bottle whose design may be adapted to many different styles of bottles.

Yet another object of the present invention is to provide a new and improved non-spill medicine bottle that may be used with both liquid and solid products.

Even still another object of the present invention is to provide a non-spill medicine bottle comprising a bottle having a body coupled to a neck terminating in an opening adapted to allow material to pour therethrough, the bottle having a plurality of plates disposed therein and coupled thereto, each plate offset from the other plates to define a plurality of channels, the channels adapted to inhibit the flow of material from the body at one position but allow the flow of material from the body from a plurality of positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
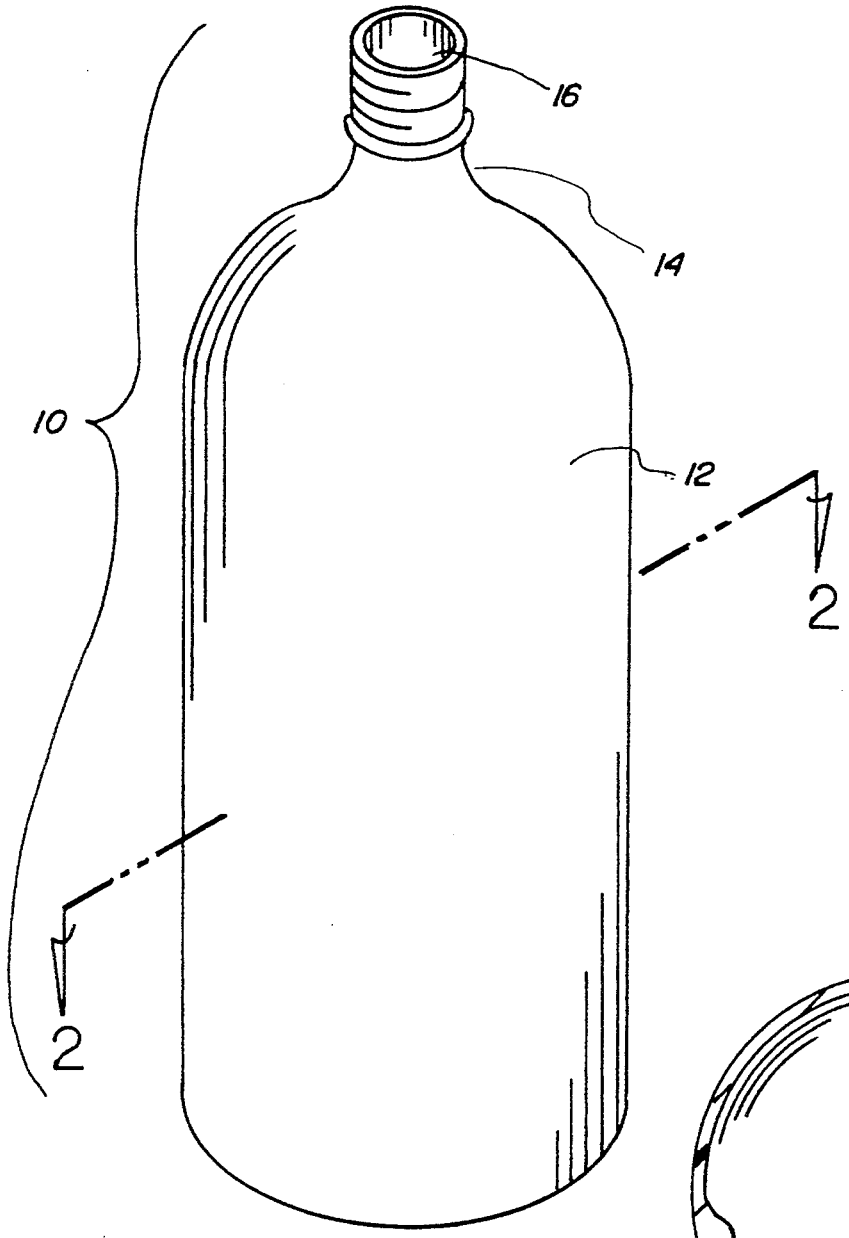
FIG. 1 is a perspective view of the non-spill medicine bottle constructed in accordance with the principles of the present invention.
Figure 2:
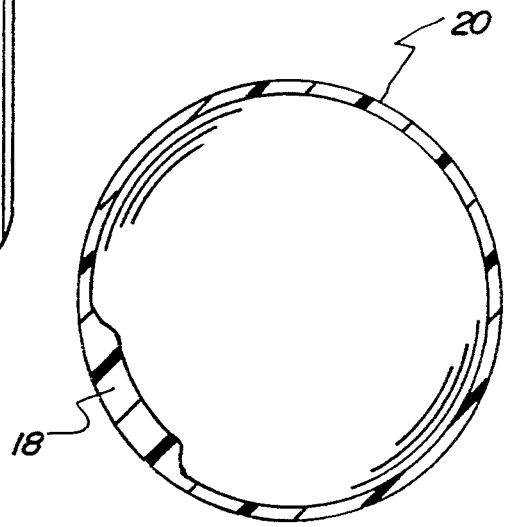
FIG. 2 is a plan view of the weighted portion of the bottle taken along the line 2—2 of FIG. 1.
Figure 3:
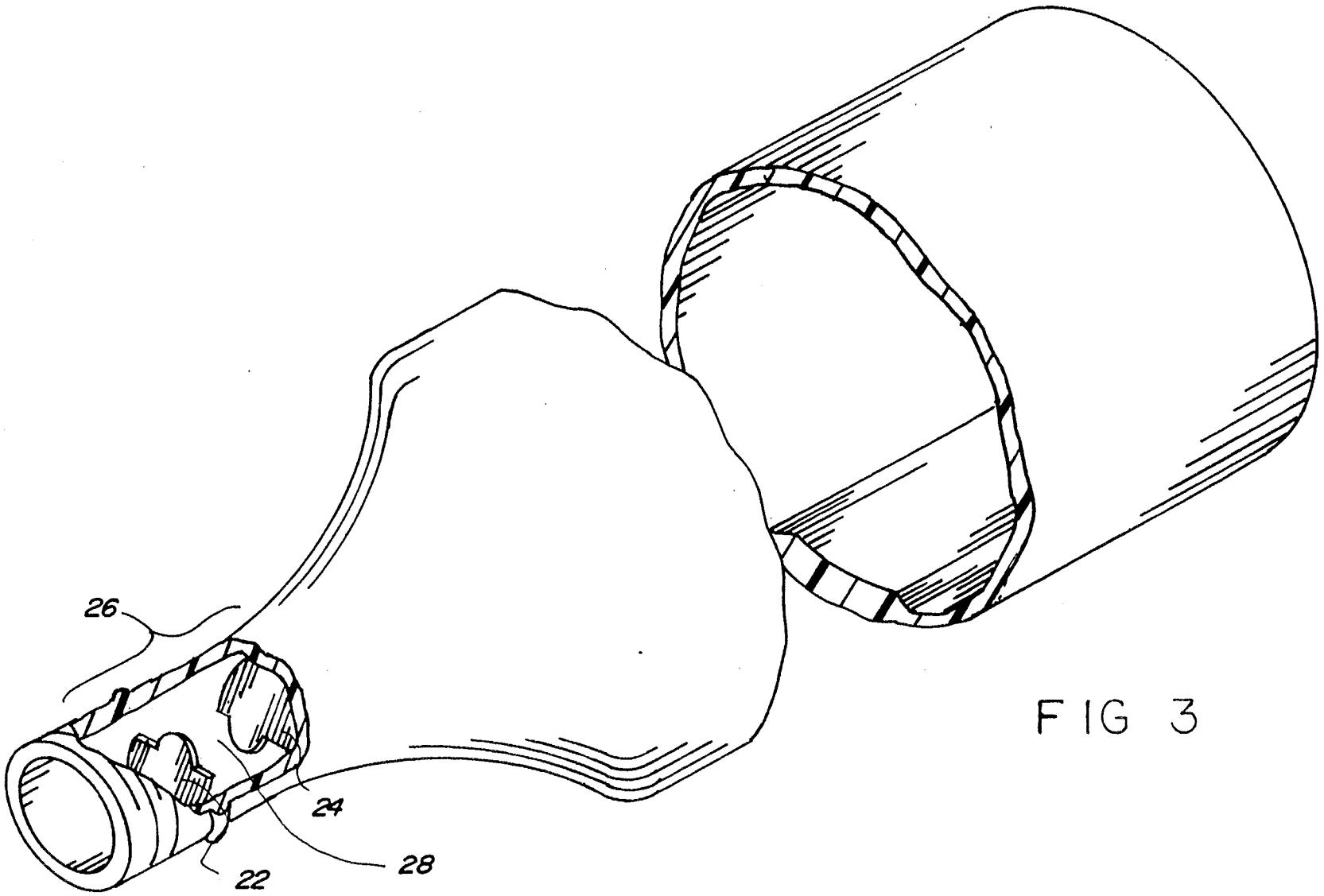
FIG. 3 is a side schematic view of the flow inhibitor disposed within the bottle.

With reference now to the drawings, and in particular, to FIG. 1 through 8 thereof, a new and improved non-spill medicine bottle embodying the principles and concepts of the present invention and generally designated by the reference number 10 will be described.

The non-spill medicine bottle 10 comprises a bottle having a tubular body 12 coupled to an elongated neck 14. The neck terminates in an opening 16 adapted to allow liquid to pour therethrough.

The body has a weighted portion 18 formed thereon with the periphery of the body defining an integral side 20. When the bottle is freely placed or knocked over on its side, it automatically rolls to a location such that the weighted portion 18 faces downward. A first plate 22 and a second plate 24 defining a flow inhibitor 26 are disposed within the neck 14 and coupled thereto. The first plate is aligned and offset from the second plate to define a channel 28 therebetween. The channel is adapted to inhibit or prevent the flow of liquid from the body when the weighted portion faces downward but allow the flow of liquid from the body when the weighted portion does not face downward. The plates are angled from the axis of the container by about between 50 and 70 degrees, preferably about 60 degrees. The free end of each plate passes through the axis of the container.

The flow of liquid from the bottle can also be controlled with the inhibitor based on the position of the bottle. For example, if the bottle is bulky or heavy, a user can control the flow of liquid from the bottle without having to lift it by tipping the bottle at a position where the flow from the channel is largely inhibited. The user can then change the position of the bottle slightly in one direction to increase the flow and in another direction to decrease the flow.

Figure 5:
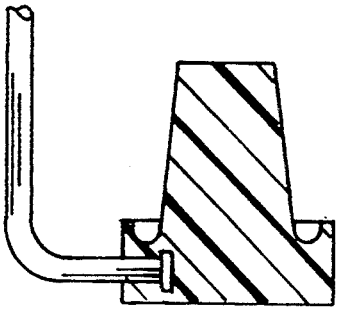
FIG. 5 is a view of the cap taken along the line 6—6 of FIG. 4.
Figure 4:
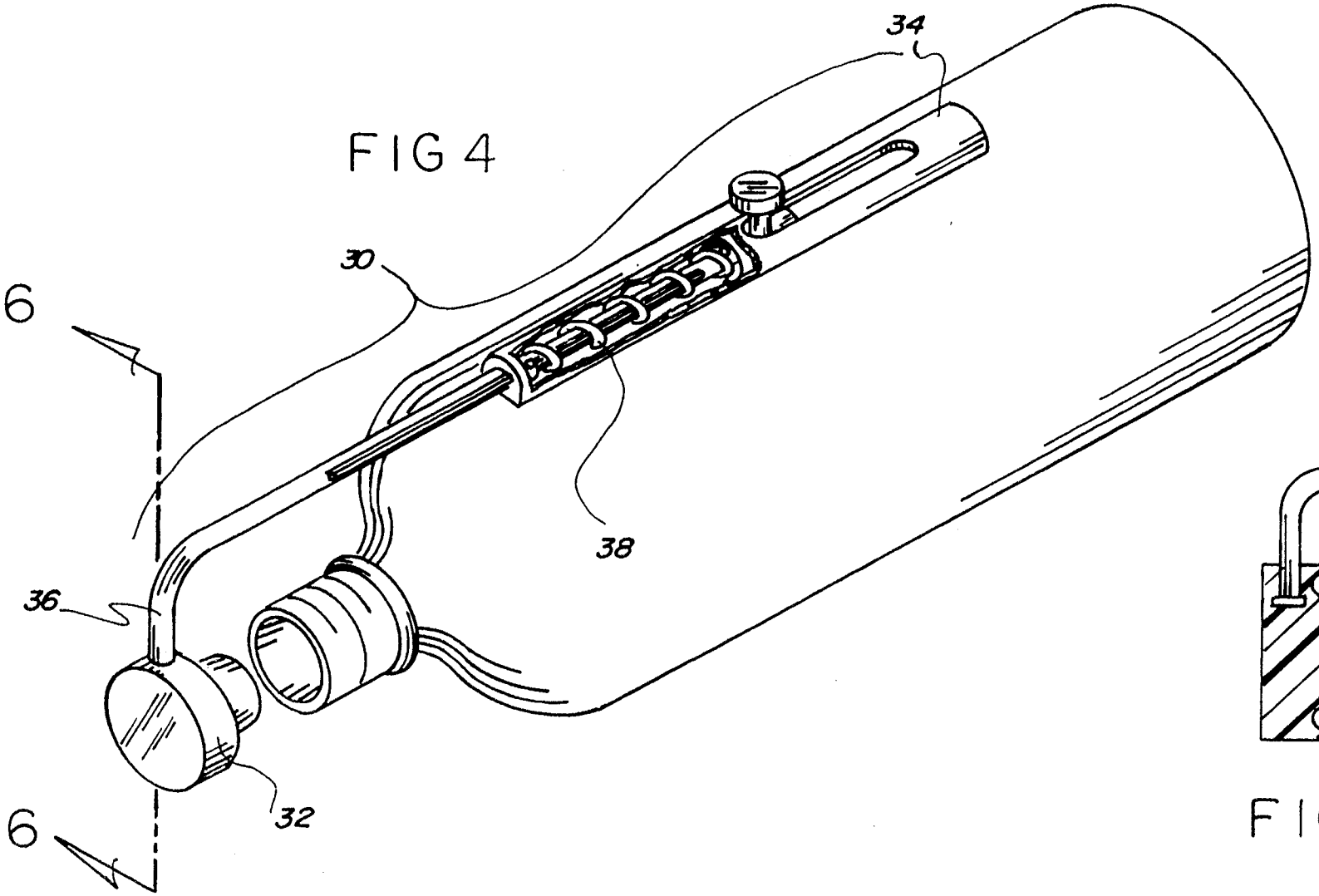
FIG. 4 is a perspective view of an alternate embodiment of the non-spill medicine bottle constructed in accordance with the principles of the present invention.

A second embodiment of the present invention is shown in FIGS. 4 and 5 comprises substantially all of the features of the first embodiment further including a cap 30 for sealing the bottle. The cap includes a top 32 adapted to be coupled to the bottle opening. The cap includes a bracket 34 coupled to the bottle. The cap further includes an elongated rod 36 having one end coupled to the cap and the other end slidably coupled to the bracket. A spring 38 is coupled within the bracket and around the rod for urging the top towards the bottle opening, whereby providing a second level of protection from spillage.

Figure 6:
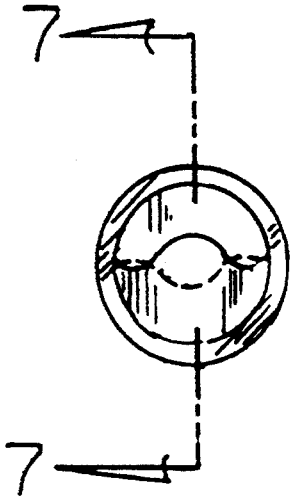
FIG. 6 is a plan view of the neck of the bottle with the flow inhibitor visible therein.
Figure 7:
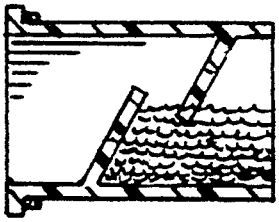
FIG. 7 is a side schematic view of the portable flow inhibitor constructed in accordance with an alternate embodiment of the present invention.
Figure 8:
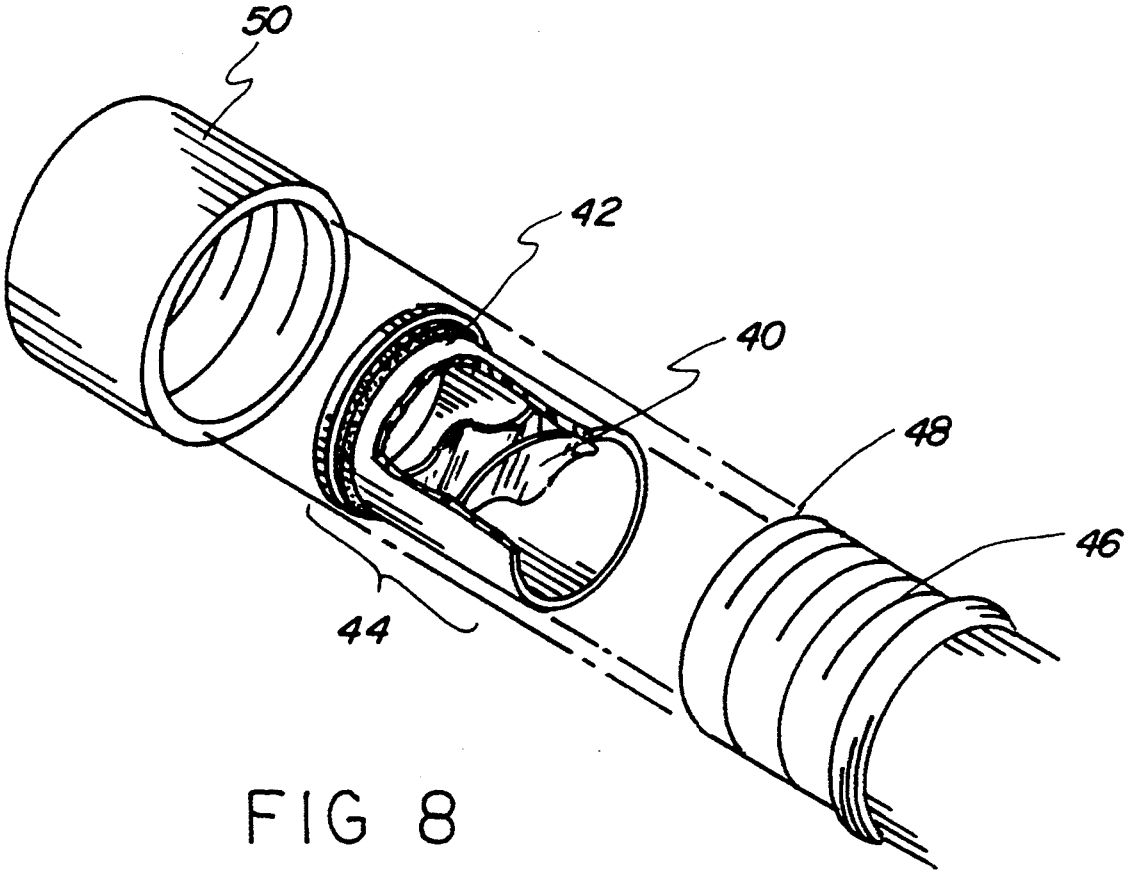
FIG. 8 is an perspective view of the portable flow as shown in FIG. 7.

A third embodiment of the present invention is shown in FIGS. 6, 7, and 8 and includes a different type of flow inhibitor. The flow inhibitor includes a plurality of offset plates 40 with a tubular portion 42 coupled therearound to define a portable flow inhibitor 44. The portable flow inhibitor is adapted to be disposed in the neck 46 of a bottle adjacent to the opening 48. A ring 50 is used for coupling the portable flow inhibitor to a bottle in a given orientation. The portable flow inhibitor may be used with conventional bottles that hold liquid or solid products.

The present invention is a product that will be welcomed by pharmaceutical companies and consumers of bottled medicine alike. It is a specially deigned bottle with built-in structural flow inhibitors in the neck of the bottle. The purpose of this feature is to prevent the contents of the bottle from spilling out completely in the event that someone knocks the bottle over. On its side, the non-spill medicine bottle automatically assumes a position so that the flow inhibitors prevent or reduce spills even if the user can't react fast enough to stand the bottle upright.

The non-spill medicine bottle is weighted so that the bottle automatically rolls into position with the weight on the bottom. In this position the flow inhibitors in the neck of the bottle act to slow down or stop altogether the flow of medicine, thereby minimizing the amount of liquid lost. When the user wants to pour out some medicine, it can be done easily by holding the bottle with the weight to one side. In this position, the flow inhibitors do not function, but rather allow the liquid in the bottle to flow freely.

The non-spill medicine bottle as disclosed herein, can be adapted to many different styles of bottles and liquid products. It provides valuable protection for users of liquid medicine without reducing the convenience f bottled medicines in the least.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A non-spill medicine bottle comprising:

a bottle having a tubular body coupled to an elongated cylindrical neck with a circular cross sectional interior along its length, the neck terminating in an opening adapted to allow liquid to pour therethrough, the body having a weighted portion formed thereon with the periphery of the body defining an integral side, whereby when the bottle is freely placed on its side, it automatically rolls to a location such that the weighted portion faces downward; and a first plate and a second plate defining a flow inhibitor disposed within the neck and coupled thereto, the first plate aligned and axially offset from the second plate to define a channel therebetween, the channel adapted to inhibit the flow of liquid from the body when the weighted portion faces downward but allow the flow of liquid from the body when the weighted portion dies not face downward, each plate having a semicircular first end coupled to the interior of the neck and a second end terminating at an intermediate region within the neck, the semicircular first ends being diametrically opposed on the interior of the neck with their midpoints being aligned with the midpoint of the weighted portion.

2. A non-spill medicine bottle comprising:

a bottle having a body coupled to a neck terminating in an opening adapted to allow material to pour therethrough, the bottle having a plurality of plates defining a flow inhibitor disposed therein and coupled thereto, each plate offset from the other plate to define a channel to inhibit the flow of material from the body at one position but allow the flow of material from the body from a plurality of positions and further including a cap for sealing the bottle, the cap further comprising:

a top adapted to be coupled to the bottle opening;

a bracket coupled to the bottle;

an elongated rod having one end coupled to the cap and the other end slidably coupled to the bracket; and a spring coupled within the bracket and around the rod for urging the top towards the bottle opening.

* * * * *